US008863513B2

(12) United States Patent
Tabata

(10) Patent No.: US 8,863,513 B2
(45) Date of Patent: Oct. 21, 2014

(54) CENTRIFUGAL COMPRESSOR AND TURBO SUPERCHARGER

(75) Inventor: Masakazu Tabata, Susono (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 197 days.

(21) Appl. No.: 13/381,296

(22) PCT Filed: Mar. 18, 2010

(86) PCT No.: PCT/JP2010/054673

§ 371 (c)(1),
(2), (4) Date: Dec. 28, 2011

(87) PCT Pub. No.: WO2011/114487

PCT Pub. Date: Sep. 22, 2011

(65) Prior Publication Data

US 2012/0111002 A1 May 10, 2012

(51) Int. Cl.

| | |
|---|---|
| ***F02B 33/44*** | (2006.01) |
| ***F01D 25/24*** | (2006.01) |
| ***F02D 23/00*** | (2006.01) |
| ***F04D 29/44*** | (2006.01) |
| ***F02D 41/02*** | (2006.01) |
| ***F02D 21/08*** | (2006.01) |
| ***F02B 37/24*** | (2006.01) |
| ***F04D 29/46*** | (2006.01) |
| ***F04D 27/00*** | (2006.01) |
| *F02D 41/00* | (2006.01) |

(52) U.S. Cl.

CPC ..... *F04D 27/002* (2013.01); *F01D 25/24* (2013.01); *F02D 23/00* (2013.01); *F04D 29/444* (2013.01); *F02D 41/029* (2013.01); *F02D 21/08* (2013.01); *F02B 37/24* (2013.01); *F04D 29/462* (2013.01); *F02D 41/0007* (2013.01)

USPC ..... 60/611; 60/605.1; 415/148; 415/208.1

(58) Field of Classification Search

CPC ..... F02D 21/08; F02D 23/00; F02D 41/0007; F02D 41/0029; F02B 37/24; F04D 29/462; F04D 27/002; F04D 29/444; F04D 27/02; F04D 27/0246; F04D 29/464; F01D 25/24; F01D 17/141; F01D 17/143

USPC ..... 60/605.1; 415/208.1, 148, 150, 415/157–158, 159, 165, 206, 211.2; 417/507, 508

See application file for complete search history.

(56) References Cited

U.S. PATENT DOCUMENTS 3,784,318 A * 1/1974 Davis ..... 415/158
4,219,305 A * 8/1980 Mount et al. ..... 415/13

(Continued)

FOREIGN PATENT DOCUMENTS

JP 2001-329996 A 11/2001
JP 2004-194612 A 7/2004

(Continued)

*Primary Examiner* — Kenneth Bomberg
*Assistant Examiner* — Jason T Newton
(74) *Attorney, Agent, or Firm* — Sughrue Mion, PLLC

(57) ABSTRACT

A compressor including a housing assembly that includes a bearing housing and a compressor housing, and a movable vane. In the housing assembly, a diffuser is formed by a first diffuser wall portion and a second diffuser wall portion. The movable vane includes a base portion and vane portions. The movable vane is movable between a projected position where a facing surface of the base portion contacts with a positioning surface provided in a storage chamber and a retracted position. The compressor housing includes an affixing portion projecting further than the second diffuser wall portion, and a fastening surface being, provided, to the affixing portion. The compressor housing is assembled with the bearing housing by attaching the fastening surface to a mounting surface of the bearing housing. The positioning surface is provided in the storage chamber so as to be flush with the fastening surface.

2 Claims, 4 Drawing Sheets

(56) References Cited

U.S. PATENT DOCUMENTS

| | | | | | |
|---|---|---|---|---|---|
| 4,324,526 | A | * | 4/1982 | Berchtold et al. | 415/48 |
| 4,378,194 | A | * | 3/1983 | Bandukwalla | 415/49 |
| 4,416,583 | A | * | 11/1983 | Byrns | 415/148 |
| 4,460,310 | A | * | 7/1984 | Plunkett | 415/26 |
| 4,582,466 | A | * | 4/1986 | Szczupak | 415/150 |
| 4,844,690 | A | * | 7/1989 | DeLaurier et al. | 415/148 |
| 5,059,091 | A | * | 10/1991 | Hatfield | 415/11 |
| 5,452,986 | A | * | 9/1995 | Osborne et al. | 415/165 |
| 7,658,068 | B2 | * | 2/2010 | Mulloy et al. | 60/602 |
| 2003/0190231 | A1 | * | 10/2003 | Mulloy et al. | 415/158 |
| 2004/0247462 | A1 | * | 12/2004 | Carter | 417/407 |
| 2005/0005604 | A1 | * | 1/2005 | Mulloy et al. | 60/602 |
| 2005/0060999 | A1 | * | 3/2005 | Mulloy et al. | 60/602 |
| 2012/0230817 | A1 | * | 9/2012 | Iwata | 415/206 |
| 2013/0272864 | A1 | * | 10/2013 | Shioda et al. | 415/203 |

FOREIGN PATENT DOCUMENTS

| | | | |
|---|---|---|---|
| JP | 2005-194933 | A | 7/2005 |
| JP | 2009-270472 | A | 11/2009 |

* cited by examiner

CENTRIFUGAL COMPRESSOR AND TURBO SUPERCHARGER

CROSS REFERENCE TO RELATED APPLICATION

This application is a National Stage of International Application No. PCT/JP2010/054673 filed Mar. 18, 2010, the contents of which are incorporated herein by reference in their entirety.

TECHNICAL FIELD

The present invention relates to a centrifugal compressor provided with a movable vane moving in and out of a diffuser passage, and a turbo supercharger having the centrifugal compressor.

BACKGROUND ART

There is a known centrifugal compressor in which a vane movable between a position where it is projected into a diffuser passage and a position where it is housed in a housing chamber provided in a diffuser wall is provided in a diffuser portion (see Patent Literature 1).

CITATION LIST

Patent Literature

Patent Literature 1: JP-A-2001-329996

SUMMARY OF INVENTION

Technical Problem

In the centrifugal compressor of the Patent Literature 1, the vane collides against an opposed side diffuser wall when the vane moves to reach the projected position. Thereby, there is a possibility that the vane is deformed in this moment and a part of the opposed side diffuser wall which has collided against the vane wears away. In order to prevent this problem, it is necessary that a clearance is formed between the opposed side diffuser wall and the vane when the vane reaches the projected position. However, when the clearance is large, a supercharging efficiency is decreased. Thus, it is necessary to decrease the clearance. The size of the clearance is decided by a length of the vane projecting in the diffuser at the projected position and a distance between the diffuser walls. Thereby, by managing sizes of portions to influence the clearance in the vane and the housing, it is possible to decrease the clearance. However, when the number of the portions the size of which are managed is large, it is laborious to manage the sizes thereof and production cost is increased.

In view of the foregoing, an object of the present invention is to provide a centrifugal compressor and a turbo supercharger, which can decrease the number of portions to be the sizes of which are managed for decreasing a size of a clearance between a vane existing at a projected position and a diffuser wall.

Solution to Problem

A centrifugal compressor of the present invention comprises: a housing assembly that includes a first housing which supports a rotating shaft so as to be rotatable about an axis, the rotating shaft having an impeller on an end portion of itself, and a second housing which houses the impeller inside and is assembled with the first housing so as to be aligned in the direction of the axis with the first housing, wherein a diffuser serving as a passage space communicated with an exit side of the impeller is formed by a first diffuser wall portion of a first housing side and a second diffuser wall portion of a second housing side on outer periphery of the impeller, and a movable vane that includes a base portion which is arranged in a storage chamber provided in the first diffuser wall portion and has a facing surface opposing to the second diffuser wall portion, and vane portions which project from the facing surface to a second diffuser wall portion side, wherein the movable vane is movable in the direction of the axis between a projected position where the facing surface contacts with a positioning surface provided in the storage chamber and the vane portions project in the diffuser and a retracted position where the vane portions are retracted to a first diffuser wall portion side further than the projected position, wherein the first housing is provided with a mounting surface located in a direction perpendicular to the direction of the axis, the second housing includes an affixing portion projecting to the first housing side further than the second diffuser wall portion, and a fastening surface being provided to the affixing portion and located in a direction perpendicular to the direction of the axis, wherein the second housing is assembled with the first housing by attaching the fastening surface to the mounting surface, and the positioning surface is provided in the storage chamber so as to be flush with the fastening surface.

In the centrifugal compressor of the present invention, the positioning surface is flush with the fastening surface. Thereby, the size of a clearance between the movable vane in the projected position and the second diffuser wall portion is decided by two sizes which are the size of a distance in the direction of the axis between the fastening surface and the second diffuser wall portion and the size of a projecting length of the vane portion in the direction of the axis from the base portion. Thereby, according to the centrifugal compressor of the present invention, it is possible to decrease the number of portions to be managed about the size for decreasing the size of the clearance to two. By decreasing the number of the portions to be managed about the size to two in this manner, it is possible to suppress an influence which is given to the size of the clearance by a machining error of each portions and an assembly error. Thereby, it is possible to suppress varying the size of the clearance for each product. Further, by decreasing the number of the portions to be managed about the size, it is possible to easily manage the sizes of these portions. According to the centrifugal compressor of the present invention, since it is possible to manage the size of the clearance accurately, it is possible to decrease the size of the clearance while forming the clearance between the movable vane in the projected position and the second diffuser wall portion.

In one embodiment of the centrifugal compressor of the present invention, wherein the first diffuser wall portion may be provided with a concave portion hollowing in the direction of the axis further than the mounting surface and housing the base portion so as to be movable in the direction of the axis to become the storage chamber, the fastening surface may be attached to the mounting surface so that apart of the fastening surface covers at least a part of the concave portion, and the positioning surface may be the part of the fastening surface covering the concave portion. In this case, since the position of the movable vane in the projected position is decided directly by the fastening surface, it is possible to increase the positioning accuracy for the movable vane in the projected position. Thereby, it is possible to decrease the size of the clearance further while forming the clearance between the movable vane in the projected position and the second diffuser wall portion.

A turbo supercharger of the present invention comprises the centrifugal compressor mentioned above and a turbine, wherein the centrifugal compressor is provided to an intake passage of an internal combustion engine and the turbine is provided to an exhaust passage of the internal combustion engine, the turbine recovers exhaust energy of the internal combustion engine, and the turbo supercharger supercharges the internal combustion engine by driving to rotate the impeller of the centrifugal compressor by recovered exhaust energy.

According to the turbo supercharger of the present invention, since the turbo supercharger has the above mentioned centrifugal compressor, it is possible to decrease the number of the portions to be managed about the size for decreasing the size of the clearance between the movable vane in the projected position and the second diffuser wall portion to two. Thereby, it is possible to decrease the size of the clearance while forming the clearance between the movable vane in the projected position and the second diffuser wall portion. Accordingly, it is possible to suppress decreasing a supercharging efficiency when the movable vane reaches the projected position.

DESCRIPTION OF EMBODIMENTS

First Embodiment

Figure 1:
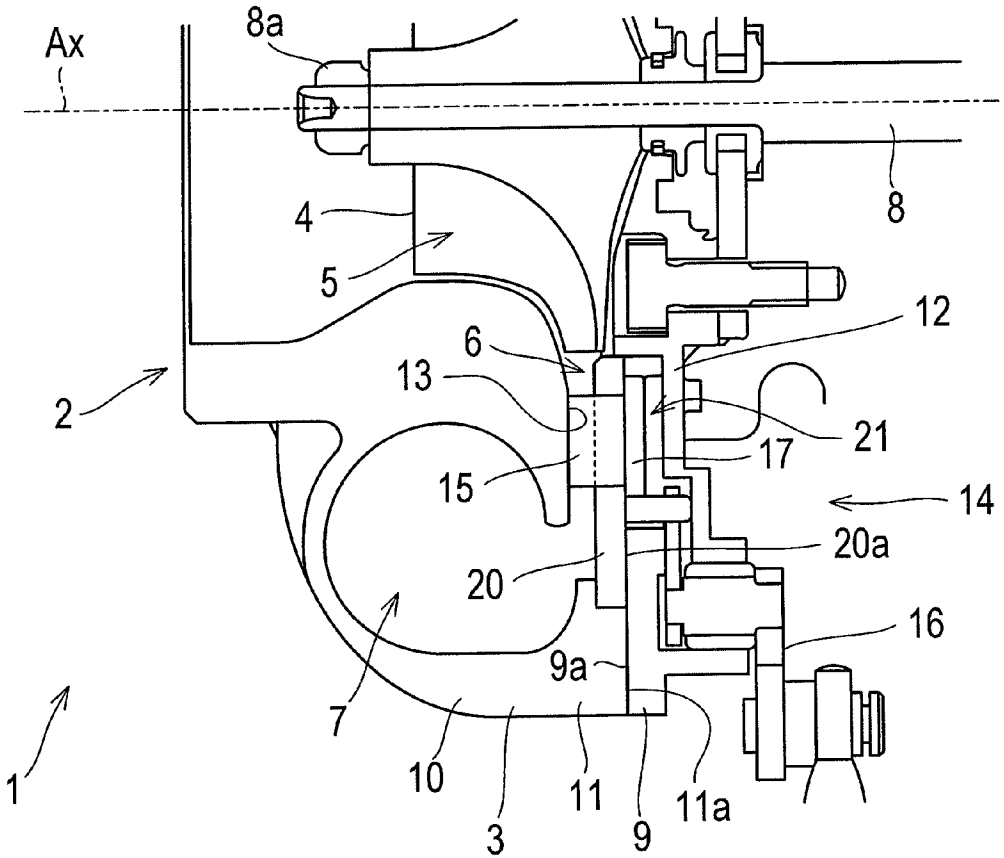
FIG. 1 is a view of a main part of a turbo supercharger in which a centrifugal compressor according to a first embodiment of the present invention is incorporated.

FIG. 1 shows a main part of a turbo supercharger in which a centrifugal compressor according to a first embodiment of the present invention is incorporated. The turbo supercharger 1 is attached to an internal combustion engine that is mounted on a vehicle as a traveling power source. The turbo supercharger 1 includes a centrifugal compressor 2 and a turbine (not shown). The turbine is similar to a turbine of a well known turbo supercharger. Thereby, illustration and description thereof will be omitted.

The compressor 2 has a housing assembly 3 and an impeller 4 housed in the housing assembly 3. The housing assembly 3 has a wheel chamber 5 in which the impeller 4 is housed, a diffuser 6 provided outward in a radial direction of the wheel chamber 4 as a passage space communicated with the exit side of the impeller 4, and a scrolled scroll chamber 7 provided outward in a radial direction of the diffuser 6 and communicated with the diffuser 6. The impeller 4 is fixed to an end portion of a rotating shaft 8 by a nut 8*a*, and rotates with the rotating shaft 8. A turbine wheel of the turbine is attached to the other end portion of the rotating shaft 8. These parts are the same as those of a well-known centrifugal compressor provided to a turbo supercharger, thus a detailed description thereof will be omitted.

Figure 2:
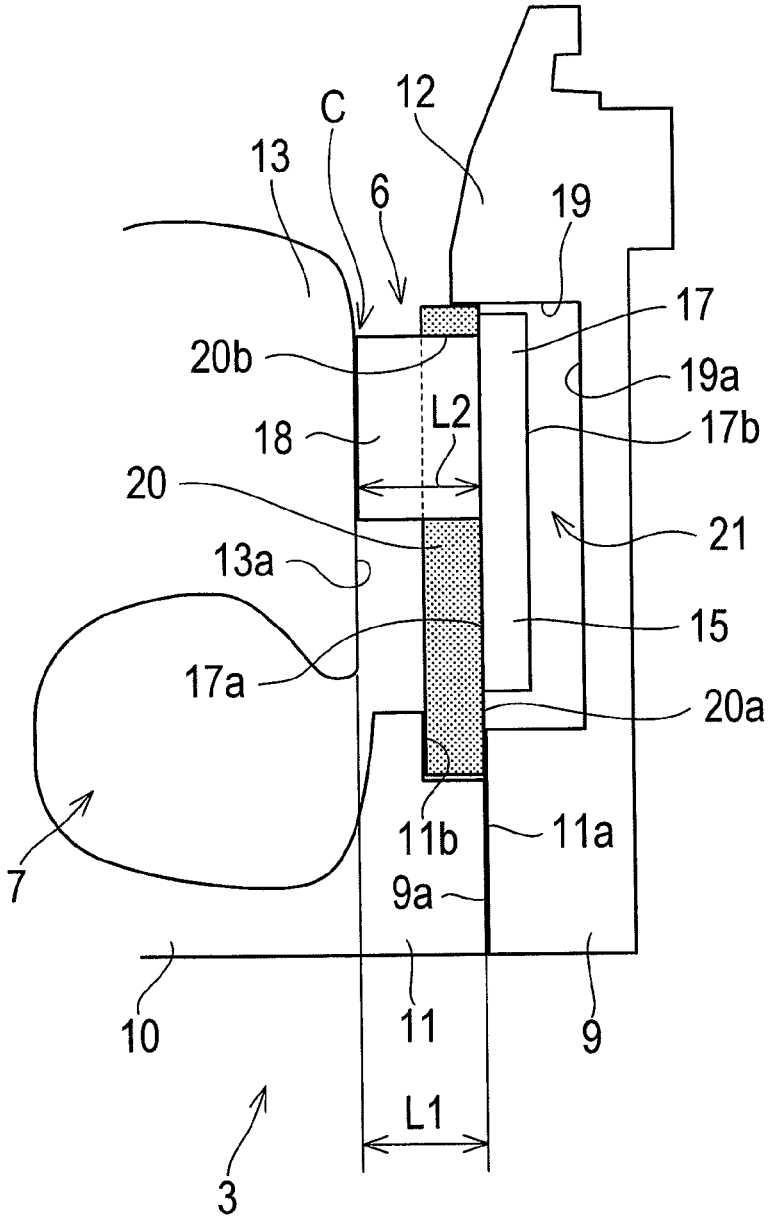
FIG. 2 is an enlarged view of a part around a diffuser.

The housing assembly 3 has a bearing housing 9 serving as a first housing and a compressor housing 10 serving as a second housing. The bearing housing 9 supports the rotating shaft 8 so as to be rotatable about an axis Ax. The compressor housing 10 houses the impeller 4 inside so as to be rotatable about the axis Ax, and is assembled with the bearing housing 9 so as to be aligned in the direction of the axis Ax with it. FIG. 2 is an enlarged view of a part around the diffuser 6. As shown in this figure, the bearing housing 9 has a mounting surface 9*a* located in a direction perpendicular to the direction of the axis Ax. The mounting surface 9*a* is arranged outward in the radial direction further than the diffuser 6. The compressor housing 10 is provided with an affixing portion 11 mounted to the mounting surface 9*a*. The affixing portion 11 is provided with a fastening surface 11*a* located in a direction perpendicular to the direction of the axis Ax as with the mounting surface 9*a*. The compressor housing 10 is assembled with the bearing housing 9 so that the fastening surface 11*a* contacts the mounting surface 9*a*.

As shown in this figure, the diffuser 6 is formed by a first diffuser wall portion 12 which is arranged on a side of the bearing housing 9 and a second diffuser wall portion 13 which is arranged on a side of the compressor housing 10. These diffuser wall portions 12, 13 are arranged so as to be aligned in the direction of the axis Ax, and to be opposed to each other. The second diffuser wall portion 13 has a wall surface 13*a* forming the diffuser 6. The wall surface 13*a* is arranged at a position which is concaved at a distance L1 in the direction of the axis Ax from the fastening surface 11*a*. The first diffuser wall portion 12 is provided with a movable vane mechanism 14. The movable vane mechanism 14 has a movable vane 15 and a driving apparatus 16 which drives the movable vane 15 in the direction of the axis Ax. The driving apparatus 16 may be a known apparatus to drive the movable vane 15 in the direction of the axis Ax by transmitting a power of an actuator (not shown) to the movable vane 15 via a link mechanism and the like. Thereby, a detailed description thereof will be omitted.

Figure 3:
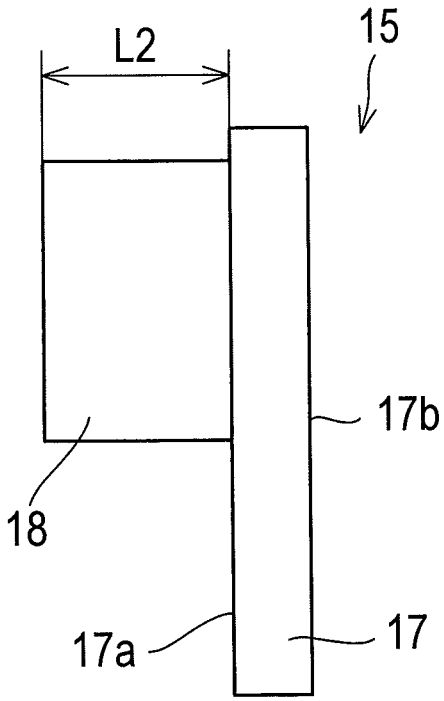
FIG. 3 is an enlarged view of a movable vane.

FIG. 3 is an enlarged view of the movable vane 15. As shown in this figure, the movable vane 15 has a hollow disk shaped base portion 17 and a plurality of vane portions 18 projected from the base portion 17. In this figure, only one vane portion 18 is shown. Each vane portion 18 projects toward the second diffuser wall portion 13 from the base portion 17. The base portion 17 has a facing surface 17*a* opposing to the second diffuser wall portion 13 and located in a direction perpendicular to the direction of the axis Ax. The vane portion 18 projects in the direction of the axis Ax from the facing surface 17*a*. As a projecting length L2 of the vane portions 18, set is a value which is slightly smaller than the distance L1 between the wall surface 13*a* of the second diffuser wall portion 13 and the fastening surface 11*a*.

The bearing housing 9 is provided with a concave portion 19 arranging inward in the radial direction of the mounting surface 9*a* and hollowing in the direction of the axis Ax from the mounting surface 9*a*. The concave portion 19 is formed around the entire outer periphery of the impeller 4. A diffuser plate 20 is mounted on the bearing housing 9 so as to cover the concave portion 19. As shown in this figure, the diffuser plate 20 is attached in a step portion 11*b* provided to the affixing portion 11 of the compressor housing 10. The diffuser plate 20 is fixed, as being sandwiched between the bearing housing 9 and the compressor housing 10. The step portion 11*b* is formed so as to be arranged at a position where a bearing housing side surface 20*a* of the diffuser plate 20 is flush with the fastening surface 11*a* in a case that the diffuser plate 20 is attached. Thereby, the diffuser plate 20 is mounted on the bearing housing 9 so that the bearing housing side surface 20*a* contacts with the mounting surface 9*a*. By covering the concave portion 19 by the diffuser plate 20 in this manner, a storage chamber 21 is formed in the first diffuser wall portion 12. The diffuser plate 20 becomes a part of the first diffuser wall portion 12 and forms one side of wall surface of the diffuser 6. The movable vane 15 is arranged in the storage chamber 21 so as to be movable in the direction of the axis Ax. The diffuser plate 20 is provided with penetrating holes 20*b* having a same shape as a cross sectional shape of the vane portion 18, and the penetrating holes 20*b* being equal in number to the vane portions 18. The movable vane 15 is arranged in the storage chamber 21 so that each of the vane portions 18 is inserted in the penetrating hole 20*b*.

Next, motion of the movable vane 15 will be described. As described above, the driving apparatus 16 drives the movable vane 15 in the direction of the axis Ax. At this moment, the driving apparatus 16 drives the movable vane 15 in the direction of the axis Ax between a projected position where the vane portions 18 are projected into the diffuser 6 and a retracted position where the vane portions 18 are retracted in the first diffuser wall portion 12. As shown in FIG. 2, at the projected position, the facing surface 17*a* of the movable vane 15 contacts with the bearing housing side surface 20*a* of the diffuser plate 20. Thereby, the position of the movable vane 15 in the projected position is decided. Accordingly, the bearing housing side surface 20*a* of the diffuser plate 20 corresponds to a positioning surface of the present invention. As described above, the projecting length L2 of the vane portions 18 is slightly smaller than the distance L1 between the wall surface 13*a* of the second diffuser wall portion 13 and the fastening surface 11*a*. Thereby, it is possible to prevent a collision between the vane portion 18 and the wall surface 13*a* in the projected position. On the other hand, at the retracted position, by contacting a surface 17*b* on the side opposite to the facing surface 17*a* of the base portion 17 with a bottom 19*a* of the concave portion 19, the position of the movable vane 15 is decided.

As described above, in the compressor 2 of the present invention, the bearing housing side surface 20*a* of the diffuser plate 20 deciding the position of the movable vane 15 in the projected position is flush with the fastening surface 11*a*. Thereby, as shown in FIG. 2, the size of a clearance C between the movable vane 15 and the second diffuser wall portion 13 in the projected position is decided by a difference between the distance L1 in the direction of the axis Ax between the wall surface 13*a* of the second diffuser wall portion 13 and the fastening surface 11*a* and the projecting length L2 of the vane portions 18. That is, it is possible to manage the size of the clearance C by managing two sizes which are the size of the distance L1 and the size of the projecting length L2. By decreasing portions to be managed about the size to two portions, it is possible to suppress an influence which is given to the size of the clearance C by a machining error of each portions and an assembly error. Thereby, it is possible to suppress varying the size of the clearance C for each product. By decreasing the number of portions to be managed about the size, it is possible to easily manage the sizes of these portions. In the compressor 2, by making the projecting length L2 of the vane portion 18 slightly smaller than the distance L1, it is possible to form the clearance C. Thereby, it is possible to prevent the vane portions 18 from deforming. Since the size of the clearance C is decided by only the size of the distance L1 and the size of the projecting length L2, it is possible to manage the size of the clearance C accurately. Thereby, it is possible to decrease the size of the clearance C while forming the clearance C between the movable vane 15 in the projected position and the second diffuser wall portion 13.

Second Embodiment

Figure 4:
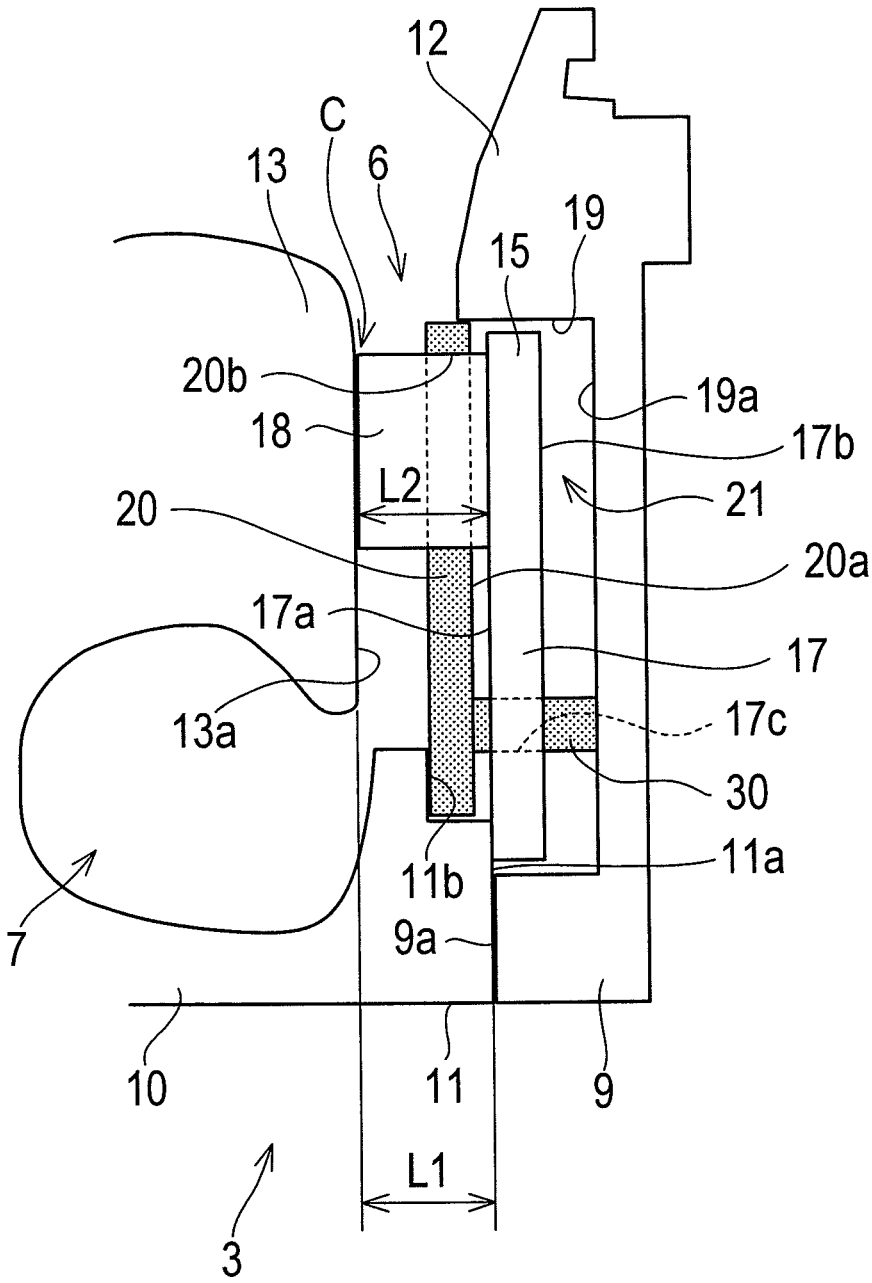
FIG. 4 is an enlarged view of a part around a diffuser of a centrifugal compressor according to a second embodiment of the present invention.

The centrifugal compressor according to a second embodiment of the present invention will be described with reference to FIG. 4. In this embodiment, the same components as those in the first embodiment are denoted by the same reference numeral, and descriptions thereof will be omitted. FIG. 4 is a figure corresponding to FIG. 2 for the first embodiment. The components which is not shown in FIG. 4 is the same as the first embodiment, thus descriptions thereof will be omitted.

As shown in this figure, in the present embodiment, by covering the concave portion 19 with the diffuser plate 20 and a part of the fastening surface 11*a* of the compressor housing 10, the storage chamber 21 is formed. The diffuser plate 20 is arranged so that the bearing housing side surface 20*a* is located closer to the second diffuser wall portion 13 than the fastening surface 11*a*. For fixing the diffuser plate 20 in such position, the diffuser plate 20 is provided with a support member 30 extending in the direction of the axis Ax from the bearing housing side surface 20*a*. The base portion 17 of the movable vane 15 is provided with a penetrating hole 17*c* penetrating in the direction of the axis Ax. The support member 30 is inserted in the penetrating hole 17*c*. As shown in this figure, in the present embodiment, the size of the base portion 17 is set so that the facing surface 17*a* of the movable vane 15 in the projected position contacts the fastening surface 11*a*. Namely, in the present embodiment, the position of the movable vane 15 in the projected position is decided by the fastening surface 11*a* of the compressor housing 10. Thereby, a part which covers the concave portion 19 in the fastening surface 11*a* corresponds to a positioning surface of the present invention. In the present embodiment, the projecting length L2 of the vane portions 18 is also set as a value which is slightly smaller than the distance L1 between the wall surface 13*a* of the second diffuser wall portion 13 and the fastening surface 11*a*.

According to the second embodiment, the position of the movable vane 15 in the projected position is decided by the fastening surface 11*a*. Thereby, similarly to the above described first embodiment, the size of the clearance C between the movable vane 15 in the projected position and the second diffuser wall portion 13 is decided by the difference between the distance L1 between the wall surface 13*a* of the second diffuser wall portion 13 and the fastening surface 11*a* and the projecting length L2 of the vane portions 18. Accordingly, it is possible to decrease the portions to be managed about the size for decreasing the clearance C to two portions. Thereby, it is possible to suppress varying the size of the clearance C for each product. It is possible to manage the sizes of the portions which can influence the size of the clearance C easily. In the second embodiment, since the projecting length L2 of the vane portions 18 is slightly smaller than the distance L1, it is possible to prevent the vane portions 18 from deforming. In this embodiment, since the position of the movable vane 15 is decided directly by the fastening surface 11*a*, it is possible to increase the positioning accuracy for the movable vane 15 in the projected position. Thereby, since it is possible to manage the size of the clearance C further accurately, it is possible to decrease the size of the clearance C further.

The present invention is not limited to the above-described embodiments, and may be executed in various modes. For example, the centrifugal compressor of the present invention may be used alone without being incorporated into the turbo supercharger.

The invention claimed is:

1. A centrifugal compressor comprising:

a housing assembly that includes a first housing which supports a rotating shaft so as to be rotatable about an axis, the rotating shaft having an impeller on an end portion of itself, and a second housing which houses the impeller inside and is assembled with the first housing so as to be aligned in the direction of the axis with the first housing, wherein a diffuser serving as a passage space communicated with an exit side of the impeller is formed by a first diffuser wall portion of a first housing side and a second diffuser wall portion of a second housing side on outer periphery of the impeller, and a movable vane that includes a base portion which is arranged in a storage chamber provided in the first diffuser wall portion and has a facing surface opposing to the second diffuser wall portion, and vane portions which project from the facing surface to a second diffuser wall portion side, wherein the movable vane is movable in the direction of the axis between a projected position where the facing surface contacts with a positioning surface provided in the storage chamber and the vane portions project in the diffuser and a retracted position where the vane portions are retracted to a first diffuser wall portion side further than the projected position, wherein the first housing is provided with a mounting surface located in a direction perpendicular to the direction of the axis, the second housing includes an affixing portion projecting to the first housing side further than the second diffuser wall portion, and a fastening surface being provided to the affixing portion and located in a direction perpendicular to the direction of the axis, wherein the second housing is assembled with the first housing by attaching the fastening surface to the mounting surface, and the positioning surface is provided in the storage chamber so as to be flush with the fastening surface, wherein the first diffuser wall portion is provided with a concave portion having a concavity extending in the direction of the axis further than the mounting surface, the concave portion housing the base portion such that the base portion is movable in the direction of the axis, the concave portion comprising the storage chamber, the fastening surface is attached to the mounting surface and a part of the fastening surface covers a part of the concave portion, wherein a diffuser plate is provided so as to cover a remaining part of the concave portion, and the diffuser plate is provided with a support member extending in the direction of the axis from a first housing side surface of the diffuser plate so that a distance between the first housing side surface and the second housing side is less than a distance between the fastening surface and the second housing side.

2. A turbo supercharger comprising the centrifugal compressor according to claim 1 and a turbine, wherein the centrifugal compressor is provided to an intake passage of an internal combustion engine and the turbine is provided to an exhaust passage of the internal combustion engine, the turbine recovers exhaust energy of the internal combustion engine, and the turbo supercharger supercharges the internal combustion engine by driving to rotate the impeller of the centrifugal compressor by recovered exhaust energy.

* * * * *